United States Patent [19]

Sporleder

[11] Patent Number: 5,067,425

[45] Date of Patent: Nov. 26, 1991

[54] REFUSE DISPOSAL DEVICE

[76] Inventor: Arthur O. Sporleder, 6440 Everhart Rd., #3D, Corpus Christi, Tex. 78413

[21] Appl. No.: 650,938

[22] Filed: Feb. 5, 1991

[51] Int. Cl.[5] ..... B63B 35/28

[52] U.S. Cl. ..... 114/26; 114/270; 110/235

[58] Field of Search ..... 114/26, 72, 73, 74 R, 114/187, 264–267, 270; 212/190; 220/1.5; 110/235, 259

[56] References Cited

U.S. PATENT DOCUMENTS

| | | | |
|---|---|---|---|
| 2,046,112 | 6/1936 | Felton . | |
| 2,442,686 | 6/1948 | Guerchoux . | |
| 4,149,480 | 4/1979 | Brakel | 114/26 |
| 4,307,679 | 12/1981 | Goldsberry et al. | 114/26 |
| 4,348,282 | 9/1982 | Fries et al. | 114/26 |
| 4,552,082 | 11/1985 | Grey . | |
| 4,829,923 | 5/1989 | Copsen et al. | 114/26 |

FOREIGN PATENT DOCUMENTS

| | | |
|---|---|---|
| 52-27190 | 3/1977 | Japan . |
| 52-31483 | 3/1977 | Japan . |
| 566518 | 9/1977 | Switzerland . |

*Primary Examiner*—Jesus D. Sotelo
*Assistant Examiner*—Stephen P. Avila

[57] ABSTRACT

An apparatus is provided comprising a refuse holding and feeding system, an incinerator, an ash pit, and an ash discharging system for the reduction of solid and wet-solid waste. The apparatus is mounted in a seaworthy vessel containing a propulsion system, steering system, crew quarters, and fuel storage.

6 Claims, 2 Drawing Sheets

REFUSE DISPOSAL DEVICE

BACKGROUND OF THE INVENTION

Prior attempts to resolve solid waste disposal problems have been unsatisfactory for the most part. There remains a need for an acceptable alternate method and it remains long overdue. Insufficient consideration has thus far been placed on long range planning. The amount of solid waste is increasing every year and, unless a solution to its disposal in an environmentally acceptable manner is found and utilized. This problem and its dangers will continue to increase. The present methods of disposal, mostly by the use of landfills, are unsanitary, unsafe, unsightly, destructive, and polluting to the air, land, and water. Attempts to obtain new landfill permits have led to law suits, unhappy citizens, and unsightly landscapes.

There has been considerable work in the field of on-land waste recovery systems. This provides a small improvement but air pollution remains a problem and a landfill is still needed to dispose of the ash and residue from these processes.

This invention pertains to certain improvements in an apparatus for the safe and sanitary disposal of solid and wet solid waste. This invention relates to a self-propelled floating vessel which has certain novel and useful features relating to the use of the self-propelled vessel to on-load, carry, incinerate, and dispose of commercial and municipal solid and wet solid combustible waste. More particularly, this invention pertains to a ship adapted by the apparatus of the present invention to be useful for the thermal decontamination and reduction of contaminated, combustible, solid, and wet-solid waste. One specific and particularly valuable use of the apparatus of this invention is the decontamination and reduction of contaminated medical waste.

The prior art has addressed the problem of the reduction and disposal of solid waste.

Felton, in U.S. Pat. No. 2,046,112, provides a ship with one or more incineration units mounted therewithin stoked from without and heated to initiate and possibly maintain incineration. The incineration units were fed by individual hoppers from the top. Grates were solid and normally closed. The incineration units were emptied into buggies which were manually wheeled to a lifting device to discharge off the outboard of the ship. There was no provision for the disposal of liquids normally found with wet-solid waste. The patent taught that solid or liquid fuel bunkers were disposed within the ship with incineration being initiated through stoking openings in the incinerating units. The feeding hoppers, one per incineration unit, were sloped inwardly to the incinerating units to facilitate feeding of refuse to the incinerator.

U.S. Pat. No. 2,442,686, Guerchoux, provides a barge with an incinerator mounted on the deck which is fed from a tender ship through a novel chute device.

U.S. Pat. No. 4,552,082, Grey, provides an ocean-going ship with an incinerator mounted thereupon for the disposal of combustible liquids and pumpable slurries and sledges. The incinerator taught by the Grey patent is of the horizontal, liquid-burning type with the waste gasses emerging horizontally. The holding tanks are located above deck. The liquid from the holding tanks is fed by gravity to sumps located below deck and then pumped into the horizontal incinerators.

SUMMARY OF THE INVENTION

It is a purpose of the present invention to provide novel, safe, clean equipment for solid, combustible waste disposal which includes, but is not limited to, municipal, residential, commercial, infectious, contaminated, and hazardous waste. The use of this disposal and dispersal invention will appreciably reduce pollution of the environment (air, water, and land) and will, when properly operated, reduce the original volume of the waste treated to about 5% or less, leaving that remaining 5% as sterilized matter to be disposed of in an acceptable manner according to 33 Code of Federal Regulations, Navigation and Navigable Waters, Part 151, Subpt. A, App. A, "Restrictions." (July 1, 1989)

Finally, the use of the ship containing the present apparatus of this invention will minimize the pollution and contamination of the air, land, and underground and surface water. The hazards and pollution caused by current waste disposal methods now existing and being utilized in many populated areas, close to landfill disposal areas, and unmonitored, individual land-based incinerators can be eliminated.

The apparatus of the present invention comprises certain well-known equipment mounted to and adapted to be used within any seaworthy ship. (1) A common refuse-storage hopper mounted within the hull of the ship having a discharge port in the bottom thereof, such hopper having a configuration to aid in the emptying of the hopper as the refuse is removed therefrom. (2) At least one incinerator mounted within the hull of the ship with exhaust stack and with baffles therewithin to control the airflow and to deflect the products from the explosion of any exploding items (as for example from heating pressurized cans and the like). (3) A main conveyer for each incinerator to transport the waste from the bottom of the storage hopper to and through each incinerator. (4) A trough under each main conveyer to receive and contain the liquids from the hopper, transport the liquids through the incinerator, and dispose of the liquid in such a manner to minimize the presence of fly-ash in the products of incineration. (5) An ash pit to mix the solid products of incineration with the liquids from (4) and as necessary with sea water. (6) A lift conveyer to remove the wet incineration products from the ash pit and discharge them at above sea level. (7) An overhead crane mounted longitudinally over the storage hopper to aid in moving the refuse to the main feed conveyer

DETAILED DESCRIPTION OF THE INVENTION

Using a seagoing ship, built or modified according to the present invention, a city of 250,000 population could process an estimated 3,000 cu. meters or an estimated 1,333 T per day for 7 days per week, 52 weeks per year. For the disposal of waste from a larger city or from a large metropolitan area of many small bed-room communities, a larger ship with one or more additional incinerators mounted therewithin is contemplated. For the present description, however, a single incinerator shall be described although it should be understood that more incinerators and their described conveyers, troughs, and ash pits shall be equivalent to the invention described hereinbelow. It is contemplated that there shall, however, be one common storage hopper. The ship to be used for the apparatus of the present invention comprises a hull containing the appropriate appurtenances for propulsion, steering, crew quarters, and fuel storage. Within and above the hull as described are contained the novel and unobvious apparatus which the inventor considers to comprise his invention: a waste receiving, storing, and discharging hopper mounted in spaced relationship from the hull, at least one incinerator and ash well, at least one main conveyer mounted to transport refuse from the hopper through the incinerator to the ash well and an ash conveyer mounted to lift the ash from the incinerator to a discharge port above sea level.

The main conveyer travels at an appropriate speed to sterilize all waste and reduce solids to about 5% or less in volume. The ship provides for storage of adequate amounts of low grade fuel to enhance the incinerating process when necessary to maintain the temperature within the incinerator and the speed of the conveyer. In a typical operation, the main conveyer travels at a rate to provide a time of 10–12 minutes in the incinerator at temperatures between about 500° C. and about 750° C.

An overhead material handling crane is provided to advance the waste material across the bottom of the hopper to the incinerator feed conveyer. At the ash well, a lift conveyer sized to accommodate the ash from an ash well conveys the ash overboard. Quenching the ash with sea water at the exit of the burn area reduces the heat and dust before the lift conveyer picks up and deposits the ash overboard. There is also provided a trough under the opening of the hopper and incinerator communicating with the ash well. Liquid, including water, from the refuse in the hopper drains into this trough and thence into the ash well where is also serves to wet the ash prior to its being discharged.

Figure 1:
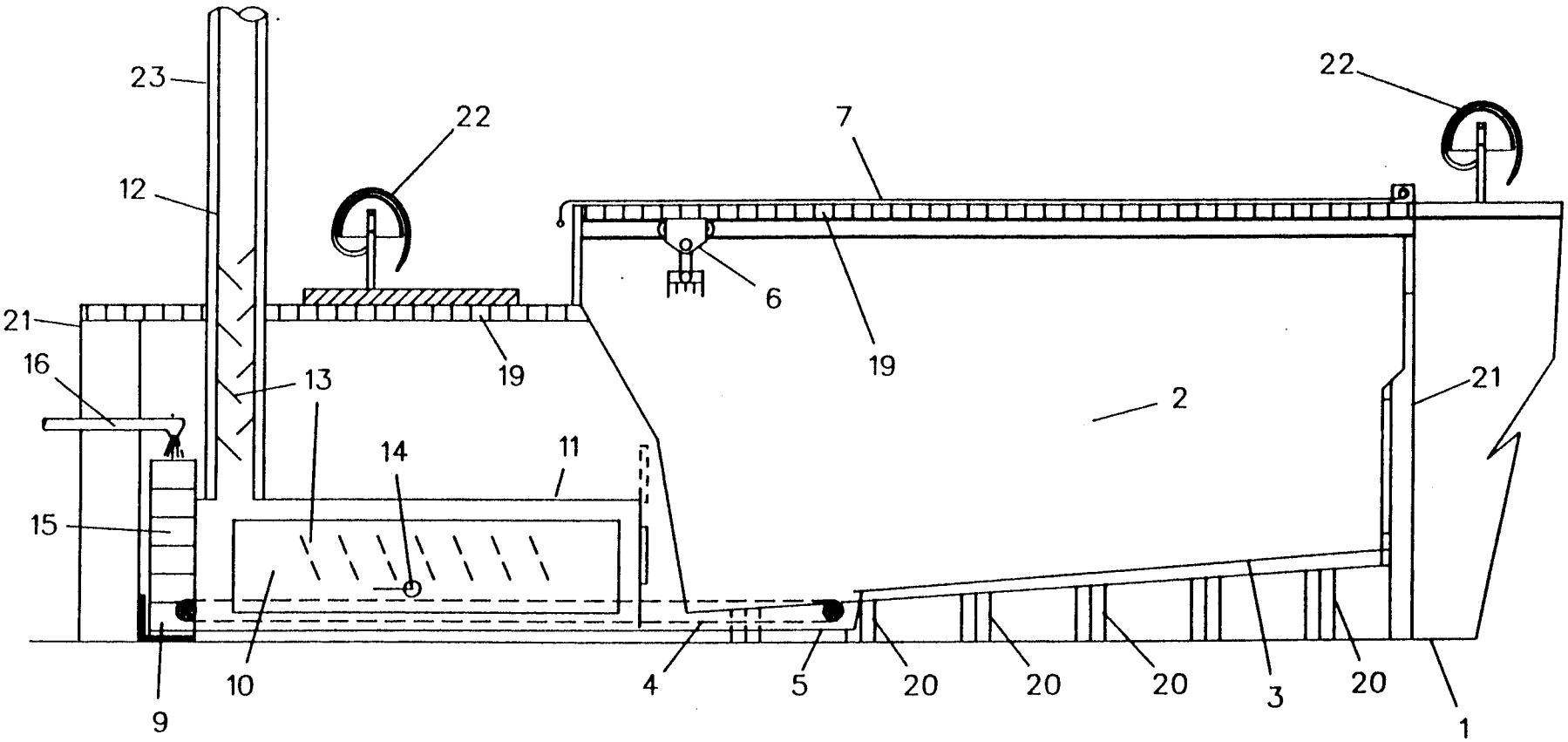

In a preferred embodiment, as shown in the figures,

FIG. 1 a side view of the overall embodiment as situated in the hull of a ship.

Figure 2:
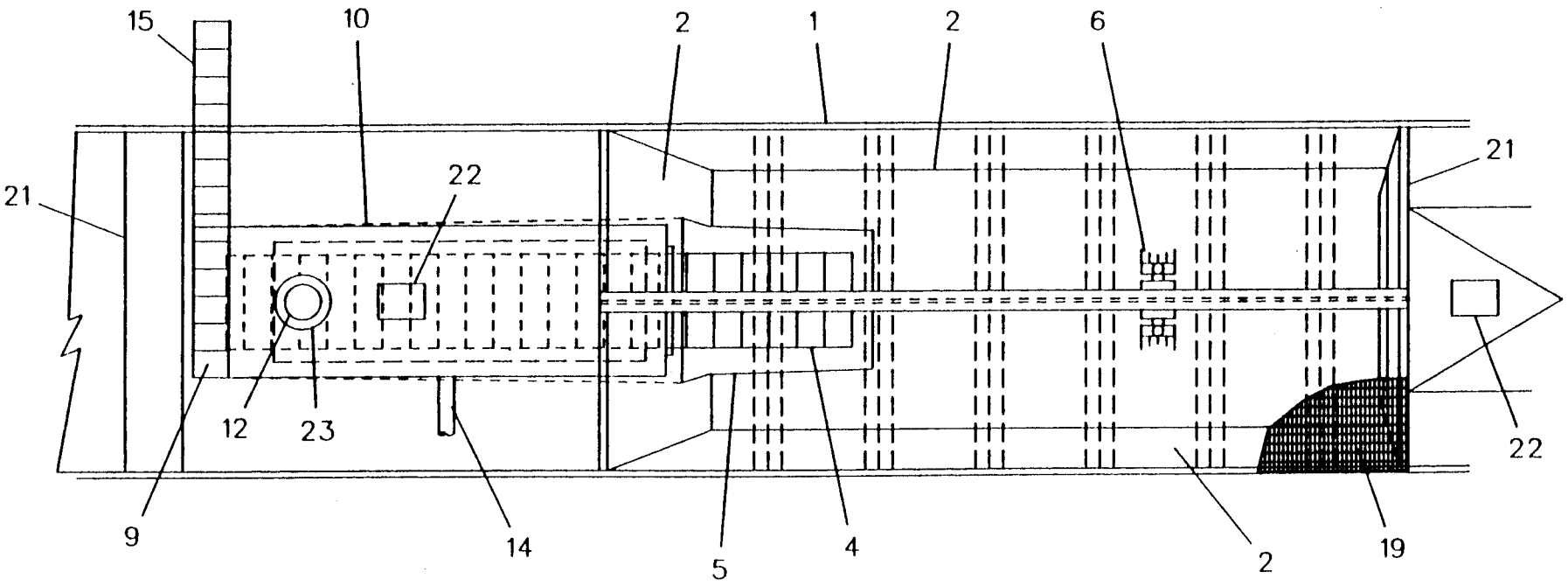

FIG. 2 shows the overhead view of the overall embodiment. For this embodiment only one incinerator and conveyer system are shown. It is to be understood that for larger capacity two to four or more incinerators and the required appurtenances may be desirable.

In the drawings, the hull 1 contains an open hopper 2 which is mounted within the hull 1 by mounts 20 at a position to place the major weight of the load at the center of the hull 1. The bottom 3 of the hopper 2 is sloped longitudinally toward the center and transversely toward an opening in the bottom thereof to feed a main feed conveyer 4. The main feed conveyer 4, preferably a travelling grate conveyer, is operated automatically to move the refuse from the hopper 2 to and through the incinerator 10 and discharging at an ash well 9. It is operated at such a speed to provide a period of from about 10 to about 12 minutes for the refuse to pass through the incinerator 10. The hopper 2 is open to the main feed conveyer 4 at the lowest end of the hopper 2. The main feed conveyer 4 travels in a trough 5 which acts as a drain for the hopper 2, and leads any liquids through the incinerator to sterilize the liquid and thence to the ash well 9. The incinerator 10 comprises a shell 11 and a vent stack 12. Baffles 13 are located in the incinerator and in the vent stack to minimize the presence of fly ash in the vent stream. The baffles also act to deflect the explosive force by which refuse may be discharged as a result of explosions as from exploding cans and the like occurring in the incinerator 10. An auxiliary fuel feed and ignition source 14 are located through the shell 11 at about the mid-point of the incinerator 10. This fuel feed point 14 can be fired as necessary to control the temperature of the incinerator 10 to maintain a temperature of from about 500° C. to about 750° C. within the incinerator 10. A lift conveyer 15, as for example, a bucket conveyer, is provided to remove the ash deposit from the ash well 9 and dump the ash overboard at a point above the water line. The ash is generally wet from the liquid which travelled from the hopper 2 through the trough 5 to the ash well 9 as described hereinbefore. If sufficient moisture is not present, it may be augmented from a deluge system 16 which sprays sea water onto the ash as it is lifted from the ash well 9 by the lift conveyer 15.

A material handling crane 6 is provided above the longitudinal mid-point of the hopper 2 which is useful to aid the movement of the refuse along the sloping floor of the hopper 2 and into the travelling grate main refuse conveyer 4. A removable olfactory and rain cover 7 is also provided which covers the whole hopper or may be stored in whole or in part in storage area 8. Expanded metal grate walkways 19 are provided throughout the length of the hopper and incinerator areas of the ship to allow ship personnel access to the material handling crane 6, to the high pressure hoses 22, and to provide maintenance and repair ways throughout the length of the ship. Fire walls 21 are provided to isolate the incinerator from the remaining areas of the ship. The incinerator stack 12 is enclosed by a heat shield 23 to reduce the hazard of burning personnel or combustibles which may be in the vicinity of the stack.

Propulsion systems, pumps, fuel storage areas, a control room, and crew quarters are obviously necessary to the operation of the ship which contains the present invention but are not to be considered elements thereof.

The operating procedure for disposal of refuse as by the use of the present invention can be described hereinbelow:

Collection vehicles dump their waste directly into the hopper 2 of the ship while the ship is docked at a space provided for the loading of the hopper 2.

When the hopper 2 is loaded, a water and olfactory cover 7 is spread over the load to keep the rain from reducing the flammability rate and to reduce any odor or wind displacement while transporting the refuse to the open sea. When passing an appropriate distance from land, as specified by the appropriate regulations, the incinerator 10 is started by igniting fuel at the auxiliary fuel feed and ignition source 14 and the feed conveyer 4 energized. A low grade fuel is preferably used for initial startup of incinerator 10 and to enhance the incineration when and as required. Controls as needed are used to control the temperature in the incinerator 10, the rate of travel of the feed conveyer 4, and the continuous operation of the incinerator 10. The material handling crane 6 advances the waste to load the feed conveyer 4 for a constant burn rate without direct personnel handling. Normal speed rate of feed conveyer 4 allows the waste products to remain in the burn area of the incinerator 10 at least four times that required for total sterilization and total combustion. This removes the problem of non-biodegradable products (plastics) by providing total incineration. After total incineration, the ash produced is quenched with sterilized liquid from the hopper 2 provided through trough 5 and/or with sea water through nozzle of the deluge system 16 to cool and contain the dust as the feed conveyer dumps the ash into an ash well 9 where the lift conveyer 15 lifts the wetted ash up and overboard gradually and within the limits of the appropriate regulations. All incineration and ash disposal is made at sufficient distance from any shore to remove any air pollution problems from land, recreational, or populated areas.

After the hopper 2 is emptied of waste, the crew washes and rinses the hopper 2 with sea water from high pressure hoses 22 to remove any particles and odors while returning to port for reloading. The returning ship is then clean and odor free. Trough 5 below the feed conveyer 4 carries the wash and rinse water from the hopper area into the ash well 9 by gravity, and the lift conveyer 15 conveys the wash and rinse liquid overboard and cleanses itself automatically.

I claim:

1. Within a self-propelled sea-going vessel comprising means of propulsion, steering, fuel storage, and crew quarters; (1) a common refuse-storage hopper having a bottom mounted within the vessel with an overhead longitudinally-mounted crane, and (2) at least one incinerator mounted within the vessel, said incinerator comprising a shell, an exhaust stack, and baffles therewithin; for each incinerator there shall be: (2a) an ignition and auxiliary fuel feed source mounted through a wall of the incinerator, (2b) a main conveyer mounted longitudinally from below an opening in the bottom of the hopper through the incinerator discharging to an ash pit, (2c) a trough mounted under the opening in the bottom of the hopper, under the main conveyer, and discharging in an ash pit, (2d) an ash pit, and (2e) a lift conveyer from the ash pit to a point above the water line of the vessel.

2. The apparatus of claim 1 wherein the main conveyer is a travelling grate conveyer.

3. The apparatus of claim 1 wherein the lift conveyer is a bucket conveyer.

4. The apparatus of claim 1 wherein a cover is mounted over the hopper.

5. The apparatus of claim 1 also containing a deluge system above the lift conveyer.

6. The apparatus of claim 1 also containing high pressure hoses to wash and rinse the hopper with sea water.

* * * * *